US008948344B2

(12) United States Patent
Kraft et al.

(10) Patent No.: US 8,948,344 B2
(45) Date of Patent: Feb. 3, 2015

(54) ANODE DISK ELEMENT COMPRISING A CONDUCTIVE COATING

(75) Inventors: Kevin Kraft, Plainfield, IL (US); Gerald James Carlson, Aurora, IL (US); Paul Xu, Oswego, IL (US)

(73) Assignee: Koninklijke Philips N.V., Eindhoven (NL)

( * ) Notice: Subject to any disclaimer, the term of this patent is extended or adjusted under 35 U.S.C. 154(b) by 345 days.

(21) Appl. No.: 13/376,449

(22) PCT Filed: Jun. 22, 2010

(86) PCT No.: PCT/IB2010/052808
§ 371 (c)(1),
(2), (4) Date: Dec. 6, 2011

(87) PCT Pub. No.: WO2011/001325
PCT Pub. Date: Jan. 6, 2011

(65) Prior Publication Data

US 2012/0093296 A1 Apr. 19, 2012

Related U.S. Application Data

(60) Provisional application No. 61/221,183, filed on Jun. 29, 2009.

(51) Int. Cl.
*H01J 35/08* (2006.01)
*H01J 35/10* (2006.01)

(52) U.S. Cl.
CPC ..... *H01J 35/108* (2013.01); *H01J 35/105* (2013.01); *H01J 2235/1245* (2013.01); *H01J 2235/086* (2013.01); *H01J 2235/1229* (2013.01); *H01J 2235/081* (2013.01)
USPC ..... 378/121; 378/143

(58) Field of Classification Search
CPC ..... H01J 35/08
USPC ..... 378/121, 143, 144, 124
See application file for complete search history.

(56) References Cited

U.S. PATENT DOCUMENTS 5,148,463 A 9/1992 Woodruff et al.
5,159,619 A 10/1992 Benz
(Continued)

FOREIGN PATENT DOCUMENTS

DE 102006061375 A1 6/2008
EP 0051335 A1 5/1982
(Continued)

OTHER PUBLICATIONS

Demerchant, Christine: "Thermal Conductivity of Carbon Fiber, and Other Carbon Based Materials", http://www.christinedemerchant.com/carbon_characteristics_heat_conductivity.html, Apr. 25, 2014, p. 2.

*Primary Examiner* — Irakli Kiknadze

(57) ABSTRACT

The present invention relates to X-ray generating technology in general, in particular, it relates to an anode disk element (1) for an X-ray generating device (21). The generation of electromagnetic radiation may be considered to be quite inefficient, since a substantial part of energy applied to a focal track is converted to heat rather than X-radiation. Thus, a limiting factor in the operation of X-ray tubes is the cooling of the anode element and more specifically the focal track. In the present invention, an anode disk element is provided, with an improved dissipation of heat from the focal track. Thus, the anode disk element may sustain increased heat while maintaining structural integrity. The anode disk element (1) comprises at least a first surface (2) and a second surface (3), with the first surface (2) comprising a focal track (4) and the second surface (3) comprising a conductive coating (5). The anode disk element (1) is rotatable about a rotational axis (6) with the focal track (4) being rotationally symmetrical to the rotational axis (6). The first surface (2) comprising the focal track (4) and the second surface (3) comprising the conductive coating (5) are adjacently arranged.

20 Claims, 8 Drawing Sheets

(56) References Cited

U.S. PATENT DOCUMENTS

| | | | | |
|---|---|---|---|---|
| 5,414,748 | A | 5/1995 | Upadhya | |
| 5,875,228 | A | 2/1999 | Truszkowska | |
| 6,430,264 | B1 * | 8/2002 | Lee | 378/144 |
| 6,907,661 | B2 | 6/2005 | Rodhammer | |
| 7,558,377 | B2 * | 7/2009 | Freudenberger et al. | 378/143 |
| 2004/0013234 | A1 | 1/2004 | Kutschera | |
| 2007/0071174 | A1 * | 3/2007 | Hebert et al. | 378/144 |
| 2008/0043921 | A1 | 2/2008 | Freudenberger | |
| 2009/0285363 | A1 | 11/2009 | Zhong et al. | |
| 2012/0099703 | A1 * | 4/2012 | Kraft et al. | 378/62 |

FOREIGN PATENT DOCUMENTS

| | | | |
|---|---|---|---|
| EP | 1748464 | A2 | 1/2007 |
| JP | 643947 | A | 1/1989 |
| JP | 0574392 | A | 3/1993 |
| JP | 05217533 | A | 8/1993 |
| WO | 2009022292 | A2 | 2/2009 |

* cited by examiner

ANODE DISK ELEMENT COMPRISING A CONDUCTIVE COATING

TECHNICAL FIELD OF THE INVENTION

The present invention relates to X-ray generating technology in general.

In particular, it relates to an anode disk element for an X-ray generating device, comprising a conductive coating, an X-ray generating device comprising an anode disk element, an X-ray system for acquiring X-ray images, a method of manufacturing an anode disk element and the use of an anode disk element comprising a conductive coating in at least one of an X-ray generating device, an X-ray tube and an X-ray system.

BACKGROUND OF THE INVENTION

X-ray generating devices are employed for example in X-ray systems for medical applications. An X-ray generating device, also known as e.g. an X-ray tube, is used to generate electromagnetic radiation, which may be used for example for medical, inspection or security imaging applications.

Regularly, electrons are accelerated between a cathode element and an anode element within an evacuated housing of an X-ray generating device for producing X-rays. The electrons impinge on a part of the anode element called the focal spot, thus creating electromagnetic radiation. Anode elements may be of a static nature or may be implemented as rotating anode elements.

X-ray generation may be considered to be very inefficient, as a major part of the applied energy is converted to heat. The dissipation of heat, in particular at the focal spot, may be considered to be one of the central limitations of X-ray tubes.

By employing a rotating anode element, the target, i.e. the area of impingement of the electrons or the focal spot, may be considered to be a stationary area on a surface of the rotating anode disk element, where moving elements of the target pass a stationary electron beam. Thus, by rotating the anode, the heat load acting on the focal spot and thus the anode may be spread over a larger circular area, increasing the possible power rating of the X-ray generating device.

SUMMARY OF THE INVENTION

There may be a need to provide an anode disk element that may sustain increased heat while still maintaining structural integrity. Furthermore, there may be a need for improved dissipation of heat from the focal track, in particular the focal spot area.

Rotating anode elements of X-ray tubes may be made up of refractory metal targets, which may have favorable properties like e.g. high temperature, high strength, good thermal conductivity and heat capacity. Rotating anode disk elements in X-ray devices may be considered to be subjected to significant mechanical stresses occurring due to rotation of the anode disk element and gantry rotation. Furthermore, anode elements may be stressed due to thermal mechanical stresses induced from the process of X-ray generation.

X-rays are generated by electron bombardment of the anode's focal track. A significant amount of energy applied to the focal spot and the adjacent anode surface is transformed into heat. Regularly, the focal spot heats up to about 2.000 to 3.000° C. during operation of the X-ray generating device. Consequently, the heat of the focal spot has to be managed, e.g. by removing that heat from the area of the focal spot.

The localized heating of the focal spot due to the impingement of electrons may be considered to be a function taking into account parameters like target angle, focal track diameter, focal spot size (length×width), rotating frequency, power applied to the focal spot and material properties such as thermal conductivity, density and specific heat of the anode disk element.

Focal spot temperatures and thermal mechanical stresses may be managed by controlling the above indicated variables or parameters.

In the following, an anode disk element for an X-ray generating device, an X-ray generating device, an X-ray system, a method of manufacturing an anode disk element and the use of an anode disk element in at least one of an X-ray generating device, an X-ray tube and an X-ray system according to the independent claims are provided.

According to an exemplary embodiment of the present invention, an anode disk element for an X-ray generating device is provided, comprising a first surface, a second surface, a focal track and a conductive coating. The anode disk element is rotatable about a rotational axis, the first surface and the second surface are adjacently arranged and the first surface comprises the focal track. The focal track is rotationally symmetrical to the rotational axis and the second surface comprises the conductive coating.

According to a further exemplary embodiment of the present invention, an X-ray generating device is provided, comprising a cathode element and an anode element, wherein the cathode element and the anode element are operatively coupled for the generation of X-rays. The anode element comprises an anode disk element according to the present invention.

According to a further exemplary embodiment of the present invention, an X-ray system is provided, comprising an X-ray generating device and an X-ray detector. An object is arrangeable between the X-ray generating device and the X-ray detector, with the X-ray generating device and the X-ray detector being operatively coupled such that an X-ray image of the object is obtainable. The X-ray generating device is provided as an X-ray generating device according to the present invention.

According to a further exemplary embodiment of the present invention, a method of manufacturing an anode disk element is provided, comprising the steps of providing an anode disk element having a first surface and a second surface, applying a focal track to the first surface and applying a conductive coating to the second surface, wherein the first surface and the second surface are adjacently arranged.

According to a further exemplary embodiment of the present invention, an anode disk element according to the present invention is used in at least one of an X-ray generating device, an X-ray tube and an X-ray system.

The anode disk element may be provided with a composite material and/or a material comprising an anisotropic thermal conductivity.

A composite material may be a material combination being composed by at least two distinct structures or materials, e.g. a fiber and a matrix.

A material with an anisotropic thermal conductivity may be seen as a material having a first thermal conductivity in a first direction of the material, while having at least a second thermal conductivity in a second direction, with the first thermal conductivity and the second thermal conductivity being unequal. E.g., a material may comprise a first thermal conductivity in a first direction, said first thermal conductivity being higher than a second thermal conductivity in a second direction. In other words, in this example, the second thermal conductivity is decreased or reduced compared to the first thermal conductivity.

Certain types of composite materials may exhibit an anisotropic thermal conductivity, in particular depending on the arrangement of the individual, distinct structures or materials, e.g. the fiber, within the composite. The individual materials may remain distinguishable even in the composed material.

It may also be conceivable, that non-composite materials as well exhibit an anisotropic thermal conductivity.

Non-composite material may also be referred to as monolithic material or homogenous material. In particular, a non-composite material may be considered to not be constituted of two or more separate dedicated materials or material structures but rather be composed of a homogenous material, in particular having a homogenous material distribution and/or material structure.

The gist of the invention may be seen as providing a conductive coating on a surface of an anode disk element, which coating provides a preferred heat dissipation or an enhanced heat dissipation in a certain direction of the anode disk element.

The conductive coating may provide a thermal conductivity in a direction of the anode disk element, in which the material of the anode disk element may have a reduced thermal conductivity when compared to a further direction of the anode disk element with a further thermal conductivity. In particular, the conductive coating may provide a thermal conductivity or heat transfer capacity, that is higher than the thermal conductivity of the anode disk element, in particular in a certain section or direction, e.g the direction of extension of the conductive coating, of the anode disk element.

In other words, the conductive coating may provide a path for heat conduction, thus dissipation of heat, on an outside of the anode disk element, that may in particular be increased compared to the heat dissipation capacity of the anode disk element insself.

The conductive coating may also be seen as providing a controlled or directed conduction of heat.

Thus, the conductive coating may be adapted for heat dissipation from the focal track in the direction of a reduced thermal conductivity of the anode disk element.

In addition, the conductive coating may provide radiation of heat.

An aspect of the present invention is to provide an anode disk element made of a composite material. A composite material may in particular be considered to comprise a matrix structure. A matrix structure may be understood as a material structure that is built by a fiber material and a matrix material, in particular being encompassed by the matrix material. The fiber material may be a non-directional or omni-directional fiber material or may comprise a defined fiber structure, in particular a woven fiber structure.

The employment of e.g. a carbon fiber reinforced carbon (CFC) composite structure for an anode disk element, in particular for a rotating anode, may allow to customize the composite material, in particular the matrix, to maximize the mechanical strength of the substrate material of the anode disk element.

In particular, the fiber material may be woven in a polar configuration, like e.g. providing true radial and circumferential fibers, thus creating a rotational symmetry for the optimization of hoop and radial mechanical properties, for a preferred adaptation to occurring stresses during rotation of the anode disk element.

A polar configuration, in particular a rotationally symmetrical polar configuration, may be seen as being composed by two separate fiber structures. One fiber structure may be considered to be substantially protruding outwards from the axis of rotation, thus being perpendicular to the rotational axis of the rotating anode element. The second fiber structure may be considered to be aligned circumferentially to the rotational axis thus being arranged substantially equidistant from the rotational axis with regard to a specific fiber. At the point of intersection of the two fiber structures, the fibers may be considered to be substantially perpendicular to one another.

While an according weave configuration is considered to be rotationally symmetrical, it is to be understood that due to the structure of weaving fibers an optimal or true rotationally symmetrical construction may not be achievable, in particular, a continuous rotational symmetry. However, even a sectional rotational symmetry is to be considered a rotational symmetry in the context of the present patent application.

Since the fiber structure of the composite material may be considered to provide good thermal conductivity, the thermal conductivity may be reduced in the cross-ply direction, e.g. the direction between individual fiber layers, due to the majority of fibers being oriented in an in-plane direction. This orientation may provide an enhanced stability and may allow to remove the localized heat from the focal spot/focal track in one, the in-plane direction along the fiber structure, while diminishing the efficiency of removal of localized heat from the focal spot and track in the cross-ply direction.

The present invention further relates to the application of a conductive coating, e.g. a heat conductive coating or thermally conductive coating, applied to a part of the anode disk element like e.g. the outermost radius part of the anode disk element, of e.g. the fiber reinforced carbon composite rotating X-ray tube anode element. An according conductive coating may be considered to constitute or create a conductive path for the localized heating from the electron bombardment to travel in the cross-ply direction of the composite material anode disk element.

In other words, since the fiber structure allows heat to dissipate mainly in the in-plane direction, propagating along the fibers of the fiber structure, the conductive coating may be considered to constitute a bridge between adjacent fiber layers, which are not directly connected by the fiber structure itself but rather lying at a certain distance spaced apart from one another by the matrix material without direct contact.

Thus, the conductive coating allows the thermal load to conduct in the axial direction of the target. Subsequently, the thermal energy may be considered to rapidly conduct in the in-plane direction through the conductive fiber matrix or fiber structure. This may provide a preferred dissipation of localized heat from the focal track.

The conductive coating may be applied using various methods. The conductive coating may be part of a focal track applied around the side of the target. In other words, the focal track and the conductive coating may be applied substantially at the same time using like materials, e.g. tungsten-rhenium. The conductive coating may be an additional application of tungsten prior to finally machining the focal track. Also, dendrite rhenium may be applied to the outer band of the rotating anode, e.g. the circumferential surface by chemical vapor deposition (CVD), in particular contacting an edge of the focal track, thus creating a conductive path for the transmission of heat.

The application of a conductive coating, in particular a conductive coating that is comprising more than necessary material may provide a machinable mass on the outer edge of the target, the anode disk element, e.g. the circumferential surface, for balancing purposes, in particular dynamic balancing purposes.

The anode disk element may be manufactured by using a composite material, in particular a preformed polar woven fiber structure having a polar configuration. A polar weave may provide true radial and circumferential fibers for the optimization of hoop and radial properties, thus providing substantially rotational symmetry.

The pre-form may be completed similarly to textile creation. Once the pre-form is completed with the desired weave, the pre-form is densified via a compression process, e.g. by pressing. However, the CFC target may still be very porous and non-continuous. The densification may be completed by pyrolytic carbon impregnation (PCI) or chemical vapor infiltration (CVI) to complete the matrix around the fibers.

After the completion of an according anode substrate, e.g. a CFC anode substrate, the focal track may be applied using chemical vapor deposition (CVD) and/or vacuum plasma spraying (VPS). Now, the conductive coating may be applied using a similar or identical method, in particular substantially at the same time as the focal track is applied.

Focal track are regularly produced out of Tungsten or an alloy of Tungsten and Rhenium, like e.g. 95% Tungsten and 5% Rhenium to 90% Tungsten and 10% Rhenium.

However, the focal track may also be made of other high z-number refractory metals. The focal track as well as the conductive coating may be made out of any or all of the same materials may like e.g. Tungsten, Tungsten alloys, Tungsten-Rhenium, Tungsten-Tantalum, Tantalum, Hafnium, Niobium, and/or Molybdenum.

Consequently, a tungsten-rhenium coating, which material may be identical to the focal track material, may be applied at the same time as the focal track to the anode disk element. This may be especially beneficial since a shielding of the side, e.g. the circumferential surface of the anode disk element, during the deposition of the focal track may be unnecessary.

In case the conductive coating and the focal track are not applied substantially simultaneous, an according shielding may be necessary due to the anisotropic nature of composite structures, in particular carbon fiber reinforced carbon structures. Protecting or shielding parts or sides of an anode disk element, especially at high temperatures, may be considered to be a difficult procedure due to differences in thermal expansion coefficients, in particular between the composite material and a shielding material.

Furthermore, a conductive coating may be applied to the anode disk element, i.e. as, or on top of, an already applied, existing conductive coating, e.g. of the sidewall or the circumferential surface, made for example from tungsten-rhenium. An according conductive coating may in particular be applied by chemical vapor deposition (CVD) and may be a dendrite rhenium conductive coating.

A conductive coating made from dendritic rhenium may provide a high temperature, high emissive coating, in particular to aid in radiative cooling of the anode structure by providing an increased radiation surface due to the material properties of the dendritic rhenium conductive coating.

The present invention may in particular be employed with anode disk elements employing a carbon matrix composite or ceramic matrix composite. X-ray tubes employing according anode disk elements may be considered as high performance products suited in particular for cardiovascular and CT medical imaging. However, according X-ray tubes may also be employed for inspection and security applications.

The pre-form may be completed similarly to textile creation. Once the pre-form is completed with the desired weave, the pre-form is densified via a compression process, e.g. by pressing. However, the CFC target may still be very porous and non-continuous. The densification may be completed by pyrolytic carbon impregnation (PCI) or chemical vapor infiltration (CVI) to complete the matrix around the fibers.

X-ray tubes may be designed either unipolar or bipolar.

Bipolar X-ray tubes employ a cathode element and an anode element, with a negative potential, e.g. −70 kV, at the cathode element and a positive potential, e.g. +70 kV, at the anode element.

Unipolar X-ray tubes may be considered to be an end grounded platform. An according unipolar X-ray tube may still employ a cathode element for accelerating electrons to an anode element having ground potential. Thus, a unipolar X-ray tube may comprise a cathode element having e.g. a potential of −140 kV, while the anode element or CFC target has e.g. zero potential. The anode element may in particular not comprise a positive potential.

Generally speaking, an electric potential is arranged between a cathode element and an anode element for the acceleration of electrons from the cathode element to the anode element. A cathode element may be understood as an electron emitting element while an anode element may be considered to be an electron receiving or electron collecting element.

CFC anodes may be considered to comprise improved characteristics, for example, for the purpose of high-end, high-power, fast rotation speed, and large power density CT systems. As the power demand increases and the focal spot size decreases, CFC anode elements provide advantages in dealing with mechanical and thermal-mechanical stresses, as well as withstanding and dealing with the thermal loads of high-end CT systems.

In the following, further embodiments of the present invention are described referring in particular to an anode disk element for an X-ray generating device. However, these explanations also apply to the X-ray generating device, the X-ray system, the method of manufacturing an anode disk element and the use of an anode disk element.

It is also noted, that arbitrary variations and interchanges of single or multiple features between individual claims and in particular the claimed entities are conceivable and within the scope and disclosure of the present patent application.

According to a further exemplary embodiment of the present invention, the anode disk element may be provided as a composite material and/or a material comprising an anisotropic thermal conductivity.

In particular a composite material may allow for a manufacture of an anode disk element with specifically tailored mechanical and structural properties to withstand increased mechanical stress and thermal exposure while maintaining structural integrity.

According to a further exemplary embodiment of the present invention, the composite material may comprise a matrix structure being composed of at least one fiber material and at least one matrix material.

The use of a composite material may allow to specifically design or tailor the shape and in particular material properties of the anode disk element for a desired application.

Fiber materials as well as matrix materials may be any material like carbon material, ceramic material, polymer material or metal.

In the context of the present patent application it may be considered to be in particular beneficial to employ a carbon-based fiber material and a carbon-based or ceramic-based matrix material.

According to a further exemplary embodiment, the composite material may comprise a polar configuration.

The fiber material, in particular the alignment or weave of the fibers of the fiber material, may be aligned in a polar configuration. A polar configuration may also be described using polar coordinates, i.e. a distance from a point or axis and an angulation or angle. An according polar configuration may comprise true radial and circumferential fibers, describable by only one polar coordinate varying, like for example varying the distance from the rotational axis with regard to radially aligned fibers and varying the angulation regarding circumferentially aligned fibers, with the respective other variable remaining constant for that particular fiber.

According to a further exemplary embodiment of the present invention, the focal track and the conductive coating may be arranged adjoiningly.

The focal track and the conductive coating may be in contact, e.g. conductive contact, in particular heat conductive contact, with one another thus allowing the transfer or dissipation of heat from the focal track to the conductive coating.

The conductive coating again may allow the dissipation of heat to further fiber material or fibers not in optimal thermal contact with the focal track.

According to a further exemplary embodiment of the present invention, the second surface is a circumferential surface.

Employing a circumferential surface as the second surface may allow a preferred dissipation of heat in the cross-ply direction in particular to provide preferred interlaminar heat dissipation e.g. in axial direction.

According to a further exemplary embodiment of the present invention, at least one of the focal track and the conductive coating may comprise at least one out of the group consisting of a tungsten-rhenium coating and a dendrite rhenium coating.

An according coating may provide a suitable material for the generation of X-radiation while providing preferred properties for heat conduction and heat dissipation.

According to a further exemplary embodiment of the present invention, the conductive coating may be adapted for heat dissipation from the focal track in the direction of reduced thermal conductivity.

By providing a conductive coating, that provides a preferred, thus increased, thermal conductivity in a direction compared to the thermal conductivity of the anode disk element in that direction, heat dissipation in that certain direction of the anode disk element may be increased without altering the internal structure of the anode disk element. The conductive coating may also be employed as a heat distribution element in a direction of reduced heat conductivity of the anode disk element.

According to a further exemplary embodiment of the present invention, the conductive coating may be adapted for heat dissipation from the focal track in axial direction.

An according conductive coating may provide a heat transfer path, in particular in the cross-ply or axial direction possibly crossing or bridging gaps or distances in the fiber structure of the anode disk element, in particular across different laminar layers not being in direct fiber to fiber contact with one another.

In the following, further embodiments of the present invention are described referring in particular to the method of manufacturing an anode disk element. However, these explanations also apply to the anode disk element, the X-ray generating device, the X-ray system and the use of an anode disk element in at least one of an X-ray generating device, an X-ray tube and an X-ray system.

According to a further exemplary embodiment of the present invention, a focal track and the conductive coating are applied substantially at the same time, in particular employing a tungsten-rhenium coating.

An according application substantially at the same time, e.g. simultaneously or at least in consecutive steps or processes of like material for both the focal track and the conductive coating may allow to neglect necessary shielding of the side surface or circumferential surface of the anode disk element, thus allowing for an easier manufacture of an according anode disk element.

According to a further exemplary embodiment of the present invention, a dendrite rhenium conductive coating may be applied as the conductive coating or, alternatively or in addition, overlaying the conductive coating.

A dendrite rhenium coating may provide a preferred heat dissipation by radiation of heat from the conductive coating, in particular away from the anode disk element. Radiation of heat may be considered to be a primary mechanism of heat transfer inside a vacuum envelope of the housing of the X-ray generating device.

Overlaying an existing conductive coating with a further dendrite rhenium conductive coating may allow to apply the focal track and the conductive coating substantially at the same time e.g. in a first step and may allow to apply an additional overlaying conductive coating e.g. made of dendrite rhenium, in a further, subsequent step. This may in particular allow to obtain an anode disk element without necessary shielding of the area of the conductive coating, e.g. the side surface or circumferential surface of the anode disk element, and further obtain the preferred heat dissipating and radiating properties of a dendrite rhenium conductive coating.

BRIEF DESCRIPTION OF THE DRAWINGS

These and other aspects of the present invention will become apparent from and elucidated with reference to the embodiments described hereinafter.

Exemplary embodiments of the present invention will be described below with reference to the following drawings.

The illustration in the drawings is schematic. In different drawings, similar or identical elements are provided with similar or identical reference numerals.

The figures are not drawn to scale, however may depict qualitative proportions.

Figure 1:
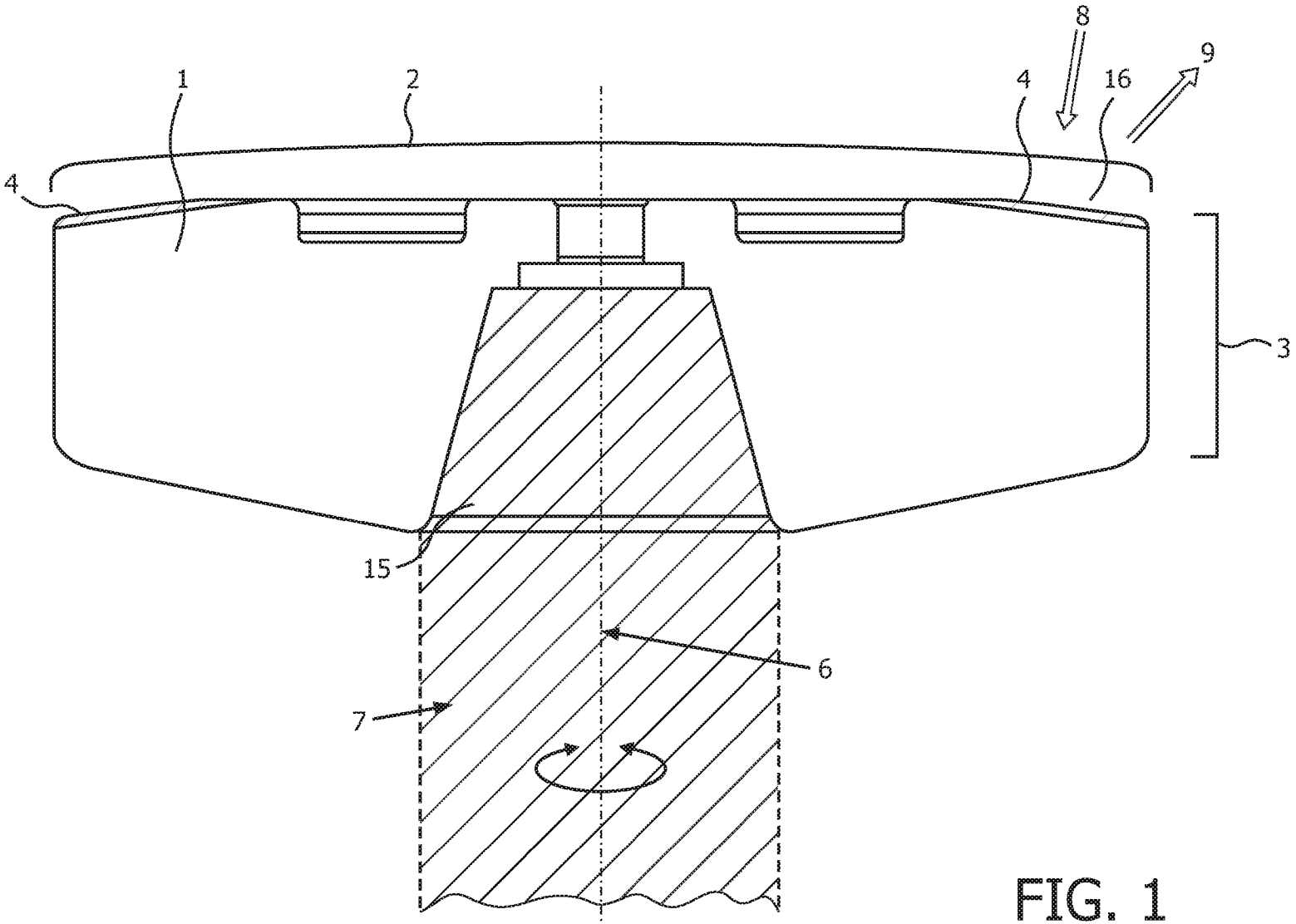
Figure 2:
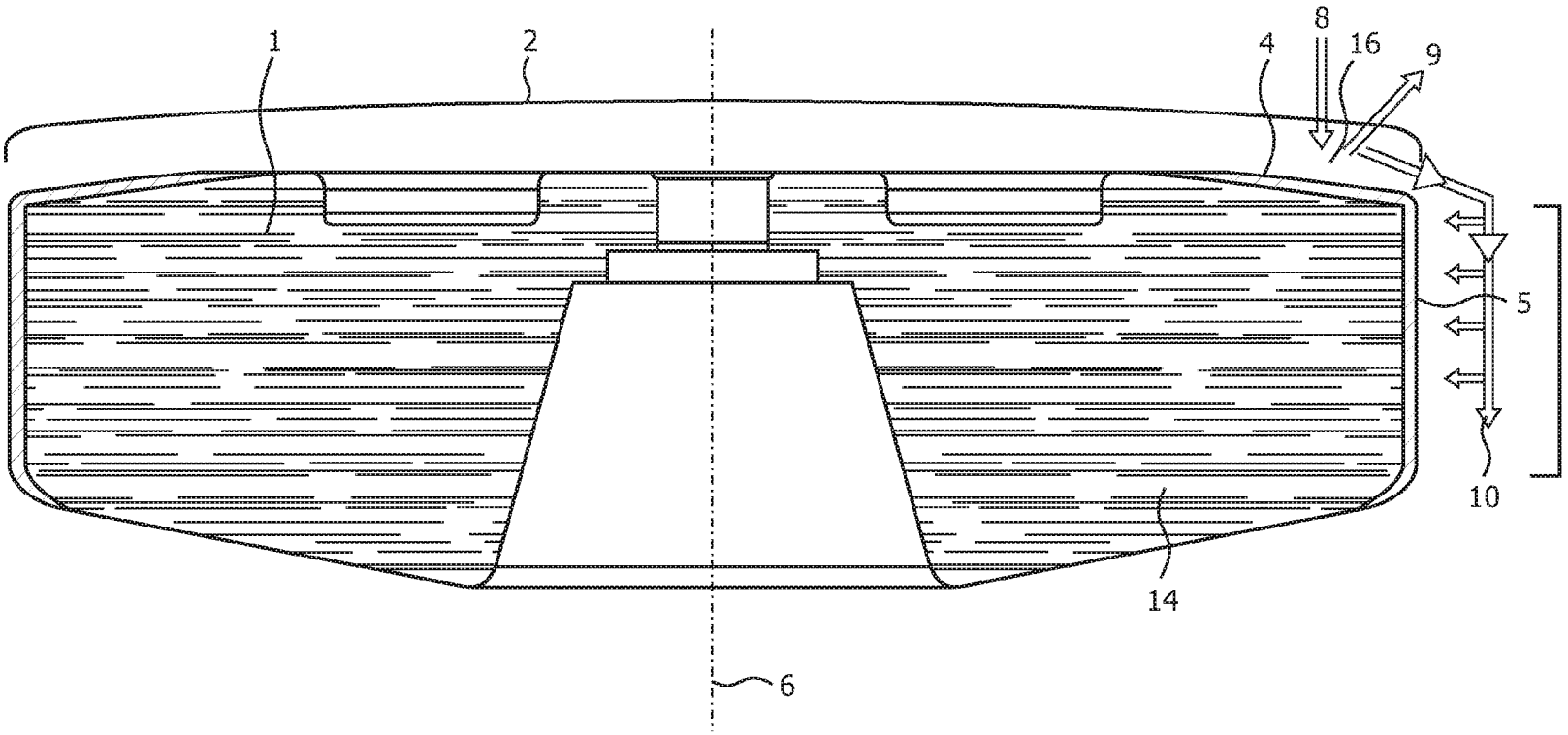
Figure 3:
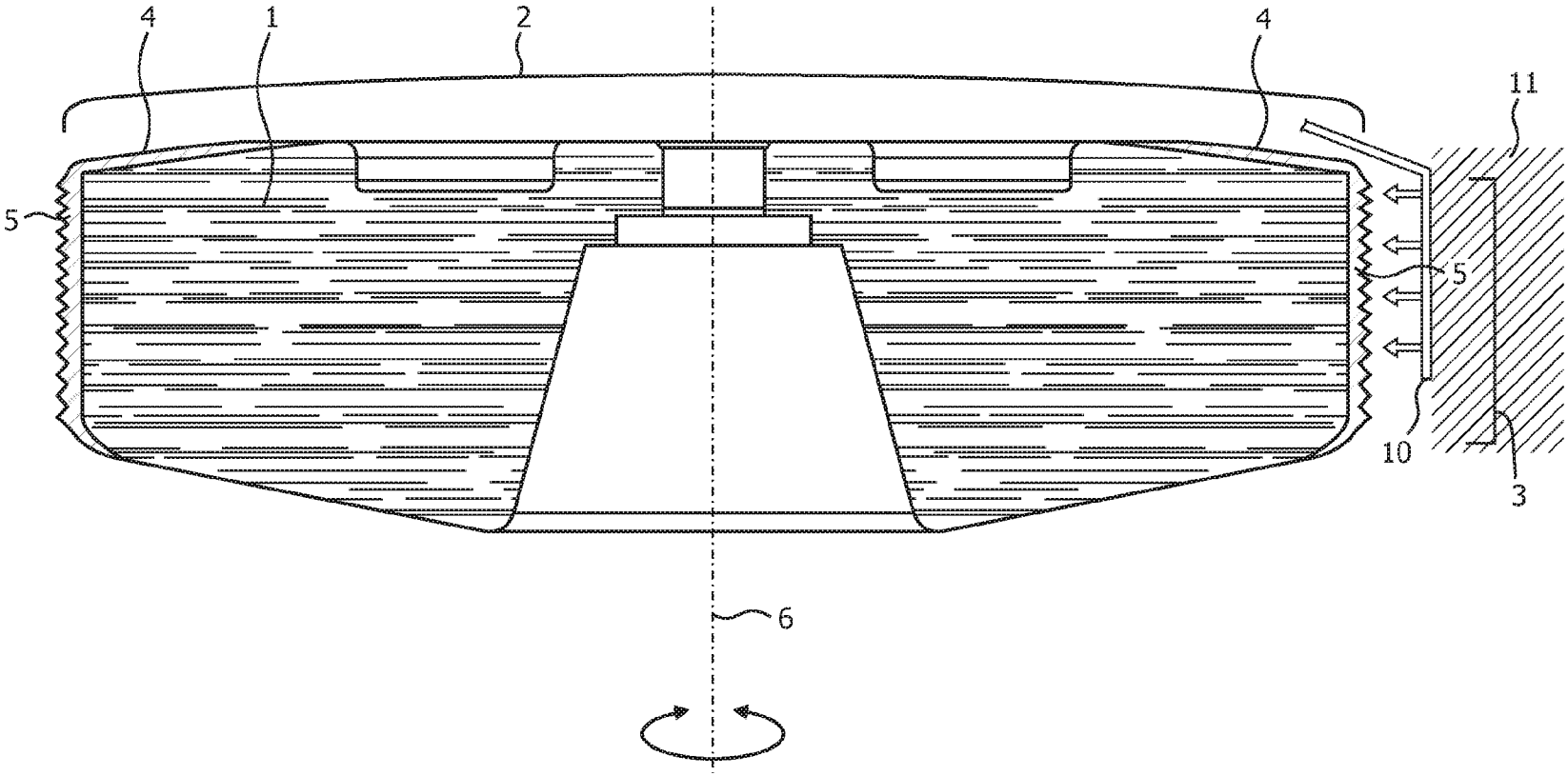
Figure 4A:
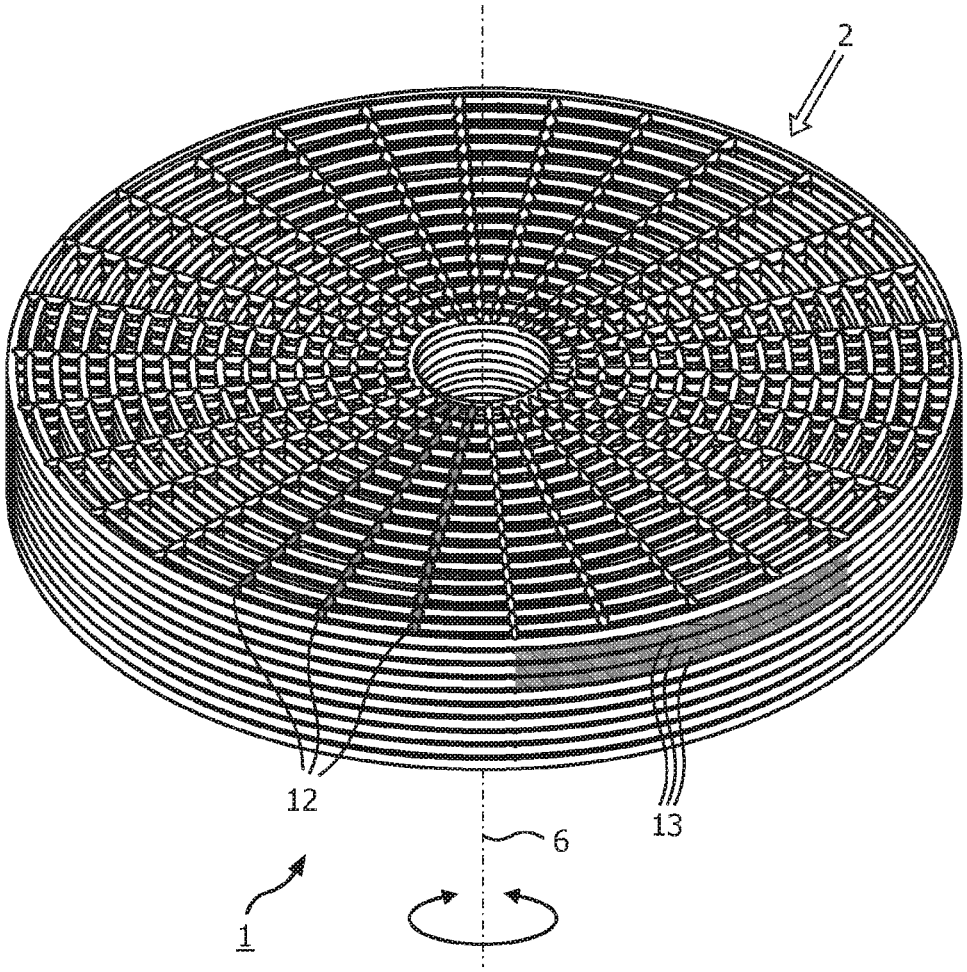
Figure 5:
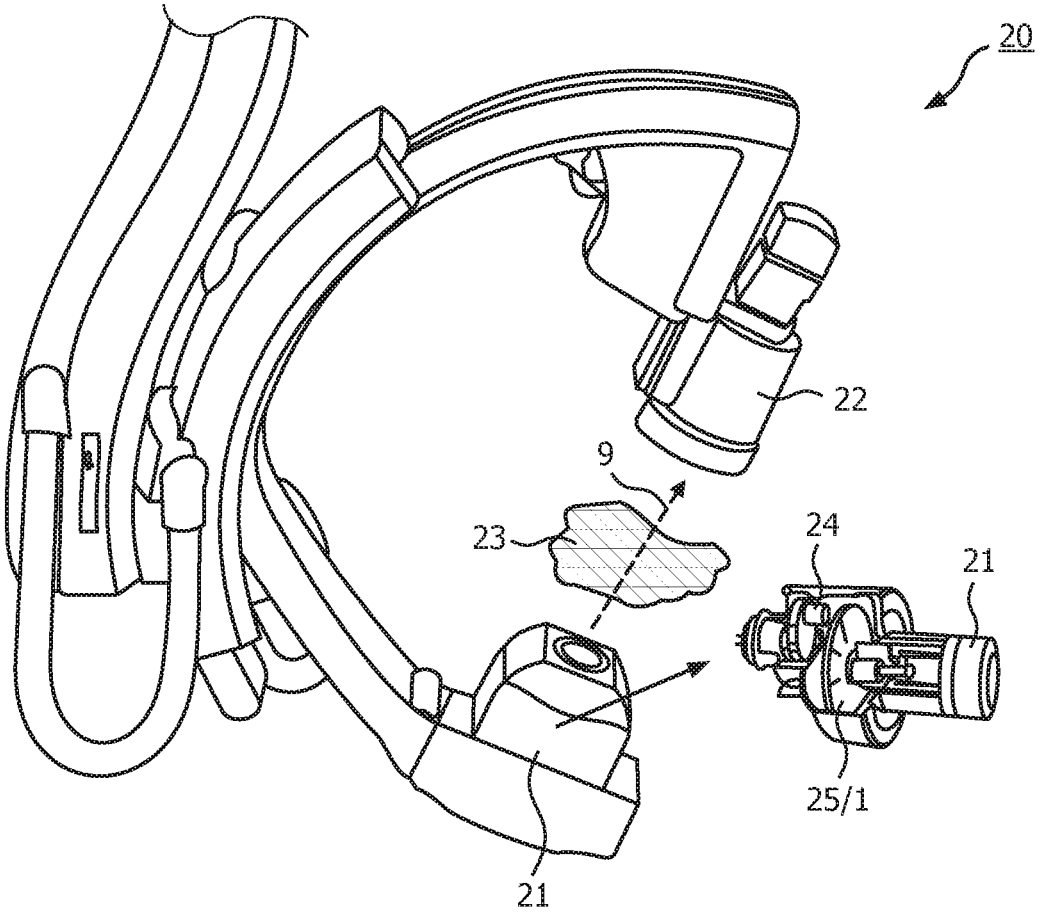
Figure 6:
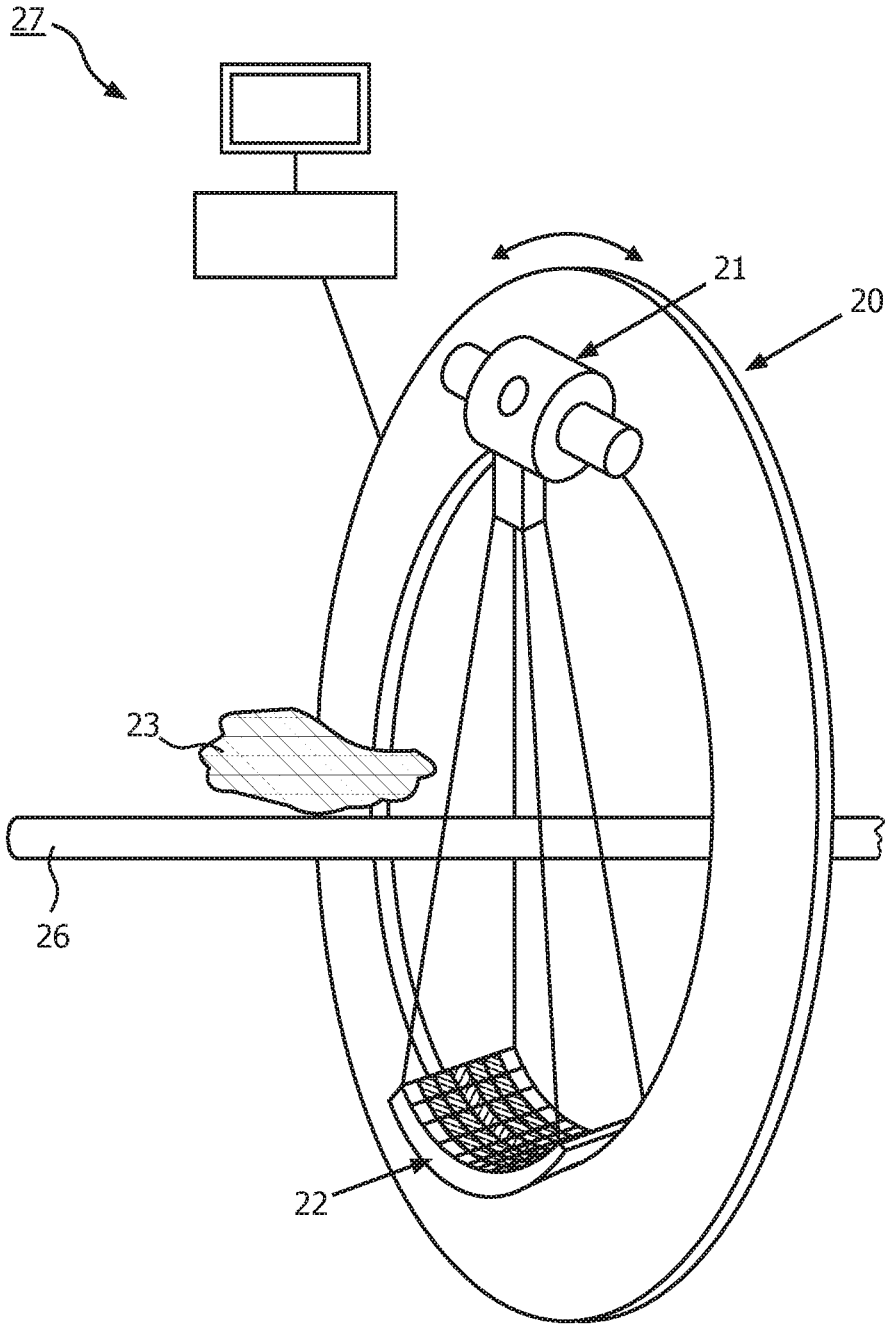
Figure 7:
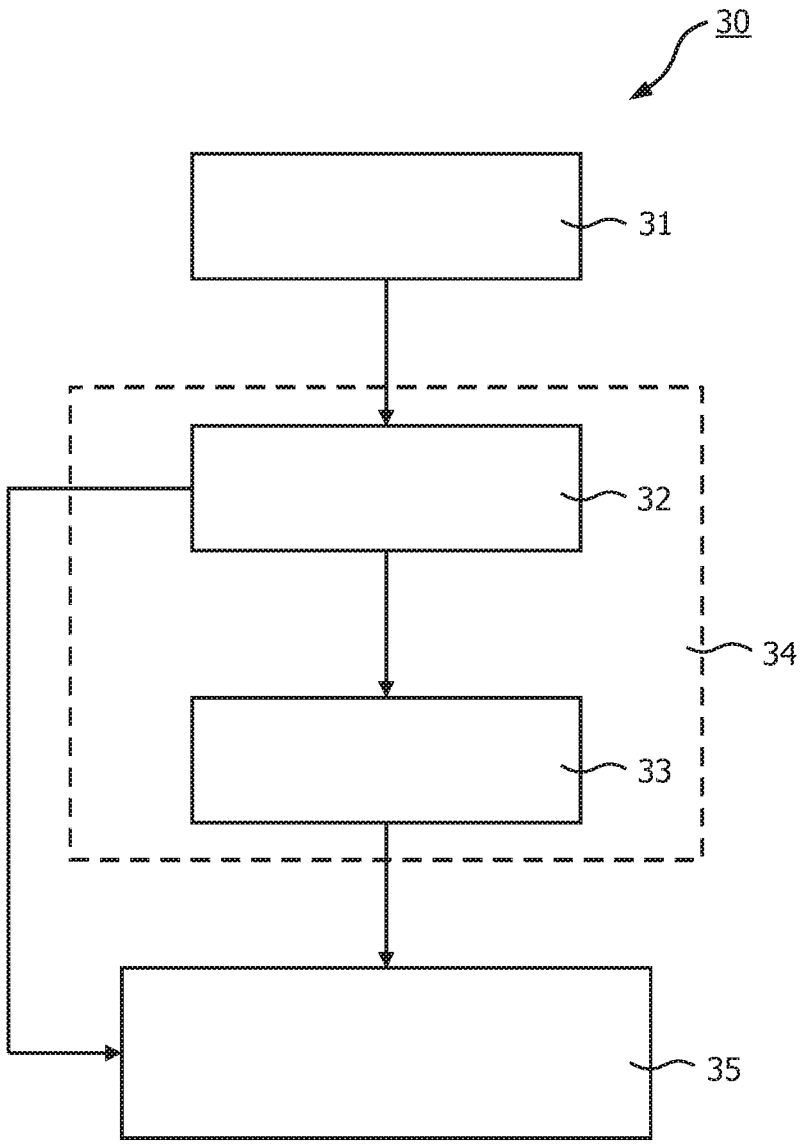
Figure 8A:
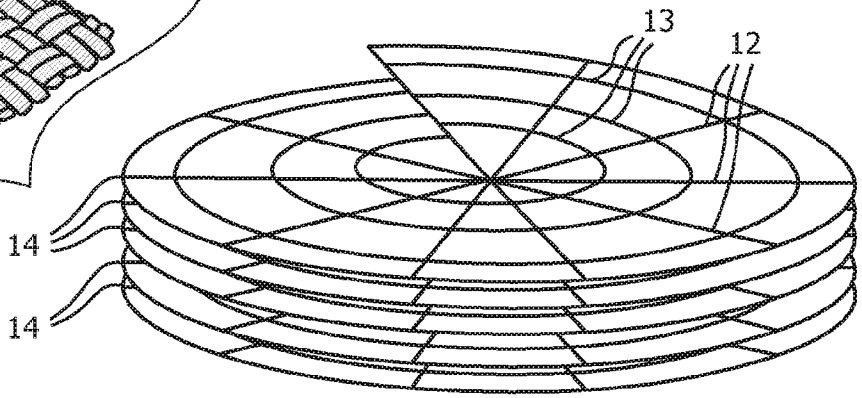

FIG. 1 shows an exemplary embodiment of an anode disk element for an X-ray generating device, FIG. 2 shows an exemplary embodiment of an anode disk element comprising a conductive coating according to the present invention, FIG. 3 shows an exemplary embodiment of an anode disk element comprising a conductive dendritic rhenium coating according to the present invention, FIGS. 4*a,b* show an exemplary embodiment of a polar configuration of an anode disk element according to the present invention, FIG. 5 shows an exemplary embodiment of an X-ray system according to the present invention, FIG. 6 shows an exemplary embodiment of a CT X-ray system according to the present invention, FIG. 7 shows a schematic flow-chart diagram of an exemplary embodiment of the method for manufacturing an anode disk element according to the present invention, and FIGS. 8*a,b* show exemplary embodiments of weave architectures of an anode disk element according to the present invention.

DETAILED DESCRIPTION OF EMBODIMENTS

Now referring to FIG. 1, an exemplary embodiment of an anode disk element for an X-ray generating device is depicted.

FIG. 1 shows an anode disk element 1, which is symmetrically built for rotation about a rotation axis 6. Anode disk element 1 comprises a recess 15 for accommodating an axis element 7, indicated by the dashed lines in FIG. 1. Further actuator elements, like e.g. a motor element within a housing of the X-ray tube, for rotating the anode disk element 1 are not depicted.

The anode disk element 1 comprises a first surface 2 on which a focal track 4 is arranged at. Focal track 4 is arranged rotationally symmetrical to the rotation axis 6 providing a continuous focal track area in at least a part of the first surface 2. In FIG. 1, the focal track is indicated to be slightly angled downwards. However, the first surface 2 may be considered to be substantially perpendicular to the rotational axis 6. Minor deviations from the perpendicularity of the first surface 2 with respect to the rotational axis 6, in particular regarding an angulation of the focal track 4 are well within design parameters of the present invention.

Focal track 4 is bombarded with electrons by electron path 8 and subsequently produces X-radiation 9 at the focal spot 16. The anode disk element comprises a second surface 3, e.g. a side surface or circumferential surface.

Now referring to FIG. 2, an exemplary embodiment of an anode disk element comprising a conductive coating according to the present invention is depicted.

Anode disk element 1 of FIG. 2 is structurally similar to the anode disk element 1 of FIG. 1. However, anode disk element 1 of FIG. 2 further comprises a conductive coating 5 on at least a part of the second surface 3, here depicted on the complete second surface 3. The conductive coating 5 also constitutes a continuous coating on the second surface 3, the circumferential side of the anode disk element 1. The focal track 4 is heated up by the bombardment of electrons 8 for the generation of X-radiation 9. Since the focal track 4 and the conductive coating 5 are in material contact, heat from the focal track 4 is conducted to the conductive coating 5 and distributed over the complete conductive coating 5 as indicated by arrow 10.

The anode disk element 1 may comprise fiber layers 14, depicted as horizontal dashes, perpendicular to the rotation axis 6. Small arrows pointing inward in the direction of the rotation axis 6 from the heat conduction arrow 10 indicate heat conduction into the inside of anode disk element 1, propagating along the fiber layers 14. Thus, heat is conducted away from the focal track 4 via conductive coating 5 and is distributed into the inside of the anode disk element 1.

Now referring to FIG. 3, an exemplary embodiment of an anode disk element comprising a conductive dendritic rhenium coating according to the present invention is depicted.

Anode disk element 1 of FIG. 3 is structurally similar to the anode disk element 1 of FIG. 2, however comprising a conductive coating 5 with a surface 4 that further provides enhanced heat radiation 11 away from the anode disk element 1, e.g. into the housing of the anode element of an X-ray generating device. An according conductive coating 5 with a preferred heat radiation 11 may be provided by employing a material with an enlarged surface structure like e.g. dendritic rhenium.

Now referring to FIGS. 4*a,b*, an exemplary embodiment of a polar configuration of an anode disk element according to the present invention is depicted.

Figure 4B:
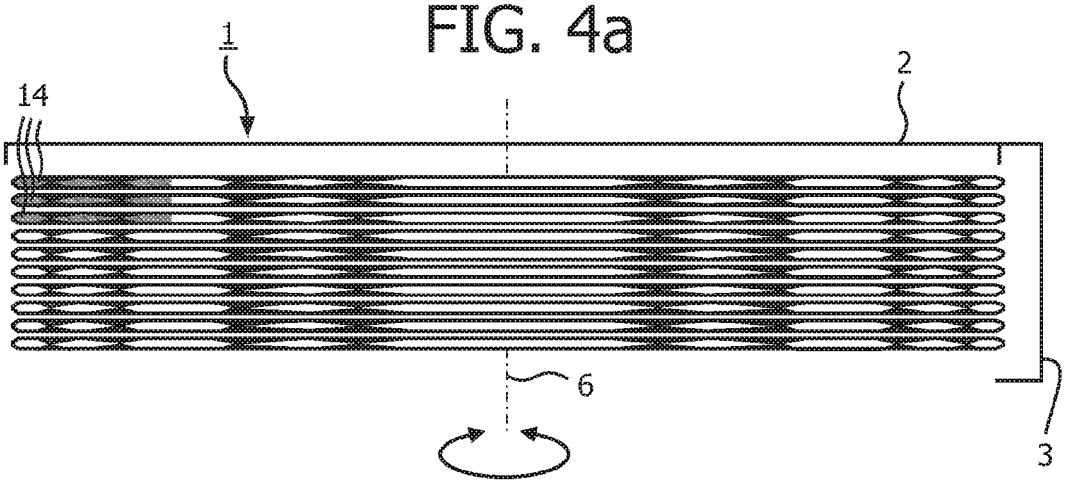

The anode disk element 1 comprises a polar configuration by employing individual fiber layers 14 as depicted in FIG. 4*b*. The individual fiber layers 14 may not be structurally connected via individual fibers, but may substantially be situated adjacent to one another, possibly being spaced apart by matrix material.

Each fiber layer 14 comprises a polar configuration. A true polar configuration may be obtained by employing a combination of true radial fibers 12 and true circumferential fibers 13, as depicted in FIG. 4*a*.

The distance or gaps between the individual fibers 12, 13, 14 in FIGS. 4*a* and 4*b* is only to illustrate the basic polar configuration of anode disk element 1. In particular, the fibers may be spaced apart with substantially smaller distances, thus arriving at substantially uniform fiber layers 14.

Now referring to FIG. 5, an exemplary embodiment of an X-ray system according to the present invention is depicted.

FIG. 5 shows an X-ray system 20, here depicted as a ceiling mounted C-arc, comprising an X-ray generating device 21, e.g. an X-ray tube, and an X-ray detector 22. An object 23 is arranged in the path of X-radiation 9 from the X-ray generating device 21 to the X-ray detector 22.

X-ray generating device 21 comprises a cathode element 24 and an anode element 25 comprising an anode disk element 1.

Now referring to FIG. 6, an exemplary embodiment of a CT X-ray system according to the present invention is depicted.

X-ray system 20 is shown in a diagnostic scenario. Object 23 is situated on a support 26 in the line of radiation 9 between the X-ray generating device 21 and the X-ray detector 22. A control system 27 is employed for controlling parameters of the desired image acquisition protocol.

X-ray generating device 21 and X-ray detector 22 are arranged to be rotatable about the object 23, in particular a region of interest positioned at the isocenter between the X-ray generating device 21 and X-ray detector 22 for the generation of three-dimensional X-ray images, which may in particular be displayed as coronal, axial and sagittal sliced images.

Now referring to FIG. 7, a schematic flow-chart diagram of an exemplary embodiment of a method for manufacturing an anode disk element according to the present invention is depicted.

Method 30 for manufacturing an anode element comprises the steps of providing 31 a composite material having a first surface and a second surface, applying 32 a focal track on the first surface, and applying 33 a conductive coating on the second surface.

The step of applying focal track and the conductive coating may be a combined step 34, occurring at substantially the same time.

Alternatively or additionally, a conductive coating may be applied 35 either as the conductive coating or overlaying the conductive coating. In particular, a dendrite rhenium material may be employed.

Now referring to FIGS. 8*a,b*, exemplary embodiments of weave architectures of an anode disk element according to the present invention are depicted.

FIG. 8*a* shows a simplified schematic illustration of the polar configuration of the anode disk element of FIG. 4*a,b*. The anode disk element is composed of individual fiber layers 14, each comprising radial fibers 12 and circumferential fibers 13.

Figure 8B:
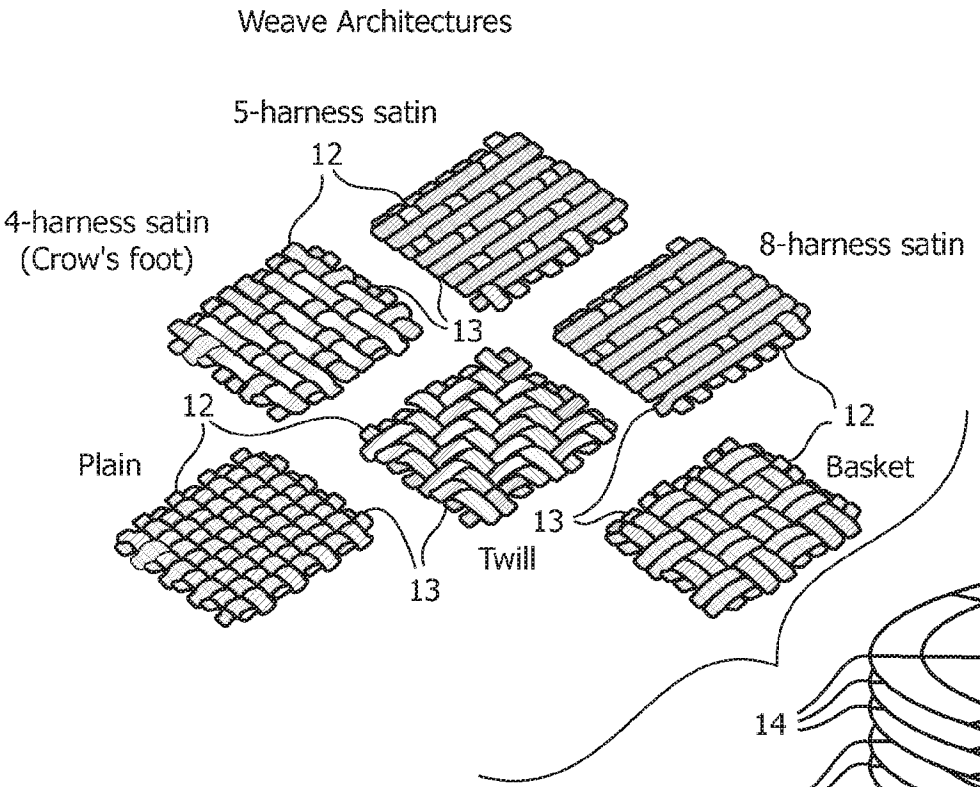

In FIG. 8*b*, individual weave pattern of the radial fibers 12 and the circumferential fibers 13 are depicted. Exemplary weave pattern or weave architectures may be plain weave, twill weave, basket weave, 4-harness satin (crow's foot) weave, 5-harness satin weave and 8-harness satin weave. Individual fiber layers 14 may comprise individual weave pattern.

As may be taken from FIG. 8*b*, at the respective point of intersection, radial fibers 12 and circumferential fibers 13 may be considered to be perpendicular relative to each other.

The weaving structure of radial fibers 12 and circumferential fibers 13 may also be exchanged to arrive at further weave patterns, thus the respective pattern is rotated substantially about 90°.

It should be noted that the term "comprising" does not exclude other elements or steps and that "a" or "an" does not exclude a plurality. Also, elements described in association with different embodiments may be combined.

It should also be noted, that reference numerals in the claims shall not be construed as limiting the scope of the claims.

REFERENCE NUMERALS

1 Anode disk element
2 First surface
3 Second surface
4 Focal track
5 Conductive coating
6 Rotation axis
7 Axis element
8 Path of electron bombardment
9 X-radiation
10 Heat conduction
11 Heat radiation
12 Radial fiber
13 Circumferential fiber
14 Fiber layer
15 Recess
16 Focal spot
20 X-ray system
21 X-ray generating device
22 X-ray detector
23 Object
24 Cathode element
25 Anode element
26 Support
27 Control system
30 Method of manufacturing an anode disk element
31 STEP: Providing a composite material
32 STEP: Applying a focal track
33 STEP: Applying a conductive coating
34 STEP: Applying focal track and conductive coating simultaneously
35 STEP: Applying conductive coating separately or overlaying conductive coating

The invention claimed is:

1. An anode disk element for an X-ray generating device, comprising:

a first surface comprising a focal track; and a second surface, the two surfaces being adjacently arranged, said second surface comprising a thermally conductive coating in direct, lateral, physical contact with said focal track for, via said contact, conduction of heat away from said focal track;

said anode disk element being rotatable about a rotational axis, said focal track being rotationally symmetrical to said rotational axis.

2. The anode disk element according to claim 1, wherein the anode disk element is provided as a composite material and/or a material comprising an anisotropic thermal conductivity.

3. The anode disk element of claim 1, provided as a composite material.

4. The anode disk element according to claim 3, wherein the composite material comprises a polar configuration.

5. The anode disk element according to claim 1, wherein the second surface is a circumferential surface.

6. The anode disk element according to claim 1, wherein at least one of the focal track and the conductive coating comprises at least one out of the group consisting of a tungsten-rhenium coating and a dendrite rhenium coating.

7. An X-ray generating device, comprising a cathode element; and an anode element; wherein the cathode element and the anode element are operatively coupled for the generation of X-rays; and wherein the anode element comprises an anode disk element according to claim 1.

8. An X-ray system, comprising an X-ray generation device; and an X-ray detector; wherein an object is arrangeably between the X-ray generating device and the X-ray detector; wherein the X-ray generating device and the X-ray detector are operatively coupled such that an X-ray image of the object is obtainable; and wherein the X-ray generating device is provided as an X-ray generating device according to claim 1, said X-ray generating device therefore comprising said anode disk element of claim 1.

9. A method for using an anode disk element according to claim 1, comprising:

including said anode disk element in at least one of an X-ray generating device, an X-ray tube and an X-ray system; and, after said including, performing said using.

10. The anode disk element according to claim 3, wherein the composite material comprises a matrix structure being composed of a fiber material and a matrix material.

11. Anode disk element for an X-ray generating device, comprising a first surface; a second surface; a focal track; and a conductive coating; wherein the anode disk element is rotatable about a rotational axis; wherein the first surface and the second surface are adjacently arranged; wherein the first surface comprises the focal track; wherein the focal track is rotationally symmetrical to the rotational axis; and wherein the second surface comprises the conductive coating, wherein the conductive coating is configured for heat dissipation from the focal track in the direction of reduced thermal conductivity.

12. The anode disk element of claim 11, the adjacency being an immediate adjacency.

13. A method of manufacturing an anode disk element, comprising the steps of:

providing an anode disk element having a first surface and a second surface;

applying a focal track on the first surface; and applying a conductive coating on the second surface, said coating being laterally, integrally part of said focal track such that the application of the integral structure applies said focal track and said conductive coating substantially simultaneously.

14. The method according to claim 13, said application being performed employing a tungsten rhenium coating.

15. The method according to claim 13, wherein a dendrite rhenium conductive coating is applied as the conductive coating or overlaying the conductive coating.

16. The method according to claim 13, wherein the anode disk element is provided as a composite material and/or a material comprising an anisotropic thermal conductivity.

17. The method of claim 13, said coating being thermally conductive.

18. The method of claim 17, further comprising the step of making said coating laterally integral with said focal track, to conduct heat away from said focal track.

19. The method of claim 18, said providing comprising providing said anode disk element as a composite material.

20. The method of claim 19, said composite material comprising a matrix structure that is composed of a fiber material and a matrix material.

* * * * *